US012005331B2

(12) United States Patent
Pulaski

(10) Patent No.: US 12,005,331 B2
(45) Date of Patent: Jun. 11, 2024

(54) GOLF CLUB FACE PROTECTOR

(71) Applicant: Jordan Pulaski, Clarence Center, NY (US)

(72) Inventor: Jordan Pulaski, Clarence Center, NY (US)

( * ) Notice: Subject to any disclaimer, the term of this patent is extended or adjusted under 35 U.S.C. 154(b) by 0 days.

(21) Appl. No.: 17/830,023

(22) Filed: Jun. 1, 2022

(65) Prior Publication Data

US 2023/0181982 A1 Jun. 15, 2023

Related U.S. Application Data

(60) Provisional application No. 63/265,370, filed on Dec. 14, 2021.

(51) Int. Cl.
*A63B 60/62* (2015.01)
*A63B 60/64* (2015.01)

(52) U.S. Cl.
CPC ..... *A63B 60/62* (2015.10); *A63B 60/64* (2015.10); *A63B 2209/08* (2013.01)

(58) Field of Classification Search
CPC ..... A63B 60/62; A63B 60/64; A63B 57/00; A63B 2209/08
See application file for complete search history.

(56) References Cited

U.S. PATENT DOCUMENTS 3,861,434 A * 1/1975 Harding ..... A63B 60/62 150/160
9,630,075 B1 * 4/2017 Wallace ..... A63B 60/62
2003/0010416 A1 * 1/2003 Cameron ..... A63B 60/62 150/160
2007/0015607 A1 * 1/2007 Hot ..... A63B 60/62 150/160
2007/0068611 A1 * 3/2007 Hwang ..... A63B 60/62 150/160
2010/0011616 A1 * 1/2010 Chang ..... A43B 13/187 36/35 R
2010/0175797 A1 * 7/2010 Dowling ..... B32B 5/26 150/160
2011/0048596 A1 * 3/2011 Low ..... A63B 57/207 15/210.1
2014/0000012 A1 * 1/2014 Mustapha ..... H01F 7/02 2/414
2017/0157487 A1 * 6/2017 Faucette ..... A63B 69/3617
2017/0216693 A1 * 8/2017 Gaffney ..... A63B 60/62
2020/0254317 A1 * 8/2020 Maeng ..... A63B 60/62
2021/0354013 A1 * 11/2021 Bailey ..... A63B 60/62

FOREIGN PATENT DOCUMENTS

KR 200276518 * 5/2002 ..... A63B 57/00

* cited by examiner

*Primary Examiner* — John E Simms, Jr.
(74) *Attorney, Agent, or Firm* — David L. Nocilly; Bond, Shoeneck & King PLLC

(57) ABSTRACT

A golf club protector that may be magnetically attached to a golf club iron to provide a protective, covering layer over at least the face of the iron. The golf club protector is formed from body having an inner layer, an outer later, and an intermediate layer positioned between the inner and outer layers. A series of magnets are positioned in the intermediate layer. The body has an outer perimeter corresponding to the shape of a golf club iron and is dimensioned to be positioned in covering relation to a face of the golf club iron.

3 Claims, 4 Drawing Sheets

GOLF CLUB FACE PROTECTOR

CROSS-REFERENCE TO RELATED APPLICATIONS

The present invention claims priority to U.S. Provisional Application No. 63/265,370, filed on Dec. 14, 2021.

BACKGROUND OF THE INVENTION

1. Field of the Invention

The present invention relates to golf club accessories and, more particularly, to golf club head covers.

2. Description of the Related Art

Golf clubs typically reside in a bag designed to hold them upright and remain accessible for easy selection and removal. Protecting the head of the club from mechanical damage while not in use has been popular for many decades and includes coverings with a multitude of designs, shapes, colorations and enclosure apparatuses. Most golf club head covers, envelop the entirety of the blade, face, back and hosel respectively; this design aspect requires that the cover contains the respective club number or corresponding label. For example, a seven iron would require the cover to be emblazed with a 7 clearly visible. The labeling needs to be made of a material that is waterproof/resistant, durable and highly visible. Because of the specificity of each individual cover, losing a cover requires replacement of that respective cover with label; for example losing a cover emblazed with a "P" for pitching wedge would demand a replacement matching that specific club and preferably brand. Traditional, fully-encasing golf club head covers can also trap moisture potentially leading to breakdown and oxidation of the golf club head. Accordingly, there is a need in the art for an approach that can protect the face of an iron without obscuring the label of the iron or unnecessarily trapping moisture that can damage the club.

BRIEF SUMMARY OF THE INVENTION

The present invention is a protective golf club face barrier that is designed to mitigate the effects of physical trauma to the club head and dampen any acoustics from striking other golf clubs without obscuring the label of the club head or forming a pocket that can trap moisture against the club. More specifically, the golf club protector is formed by a generally planar body having an inner layer, an outer later, and an intermediate layer positioned between the inner and outer layers. A series of magnets are positioned in the intermediate layer for magnetically attaching the club protector to the face of a golf club. The body has an outer perimeter corresponding to the shape of a golf club iron and is dimensioned to be positioned in covering relation to a face of a golf club iron.

BRIEF DESCRIPTION OF THE SEVERAL VIEWS OF THE DRAWING(S)

The present invention will be more fully understood and appreciated by reading the following Detailed Description in conjunction with the accompanying drawings, in which:

FIG. 3 is a first cross-sectional view of a golf club face according to the present invention.

DETAILED DESCRIPTION OF THE INVENTION

Figure 1:
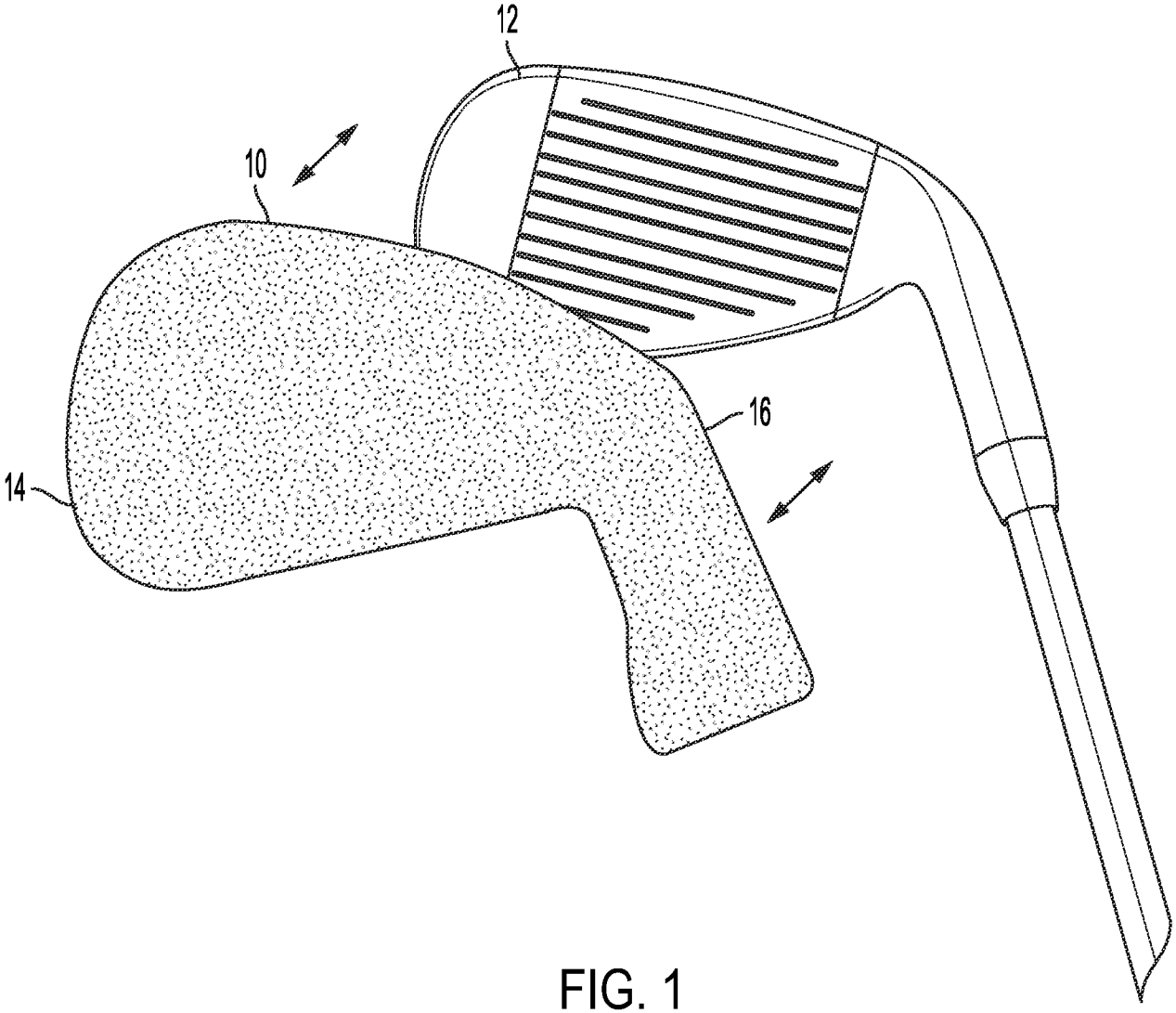
FIG. 1 is a front view of an embodiment of a golf club face protector according to the present invention for positioning in covering relation to at least the front of a golf club head.

Referring to the figures, wherein like numerals refer to like parts throughout, there is seen in FIG. 1 a golf club face protector 10 according to the present invention. As seen in FIG. 1, golf club face protector 10 is dimensioned to be positioned is covering relation to the face of a standard golf club iron 12. More specifically, golf club face protector 1 is shaped to correspond to a general golf club head shape that accommodates the traditional curves of a golf club so that a first end 14 is bulbous and curved and a second end 16 is generally narrower.

Figure 2:
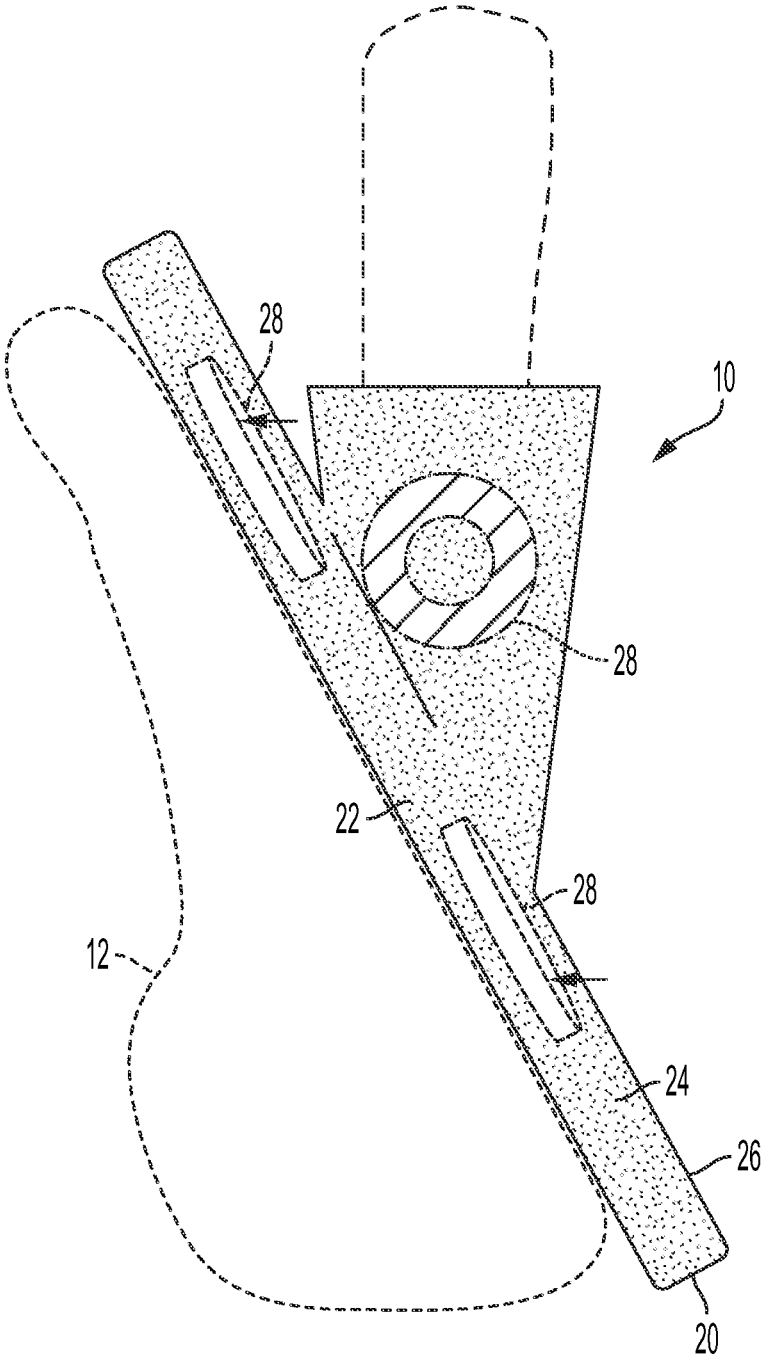
FIG. 2 is an end view of an embodiment of a golf club face protector according to the present invention positioned on golf club head and showing exemplary locations of magnets.

Referring to FIG. 2, golf club face protector 10 includes a body 20 having an inner layer 22 providing a surface to be positioned against the face of golf club iron 2, and intermediate layer 24, and an outer layer 26 that will face outwardly when golf club face protector 1 is attached to golf club iron 12. Body 20 further includes a series of magnets 28 embedded therein and positioned about body 20 in different locations to provide for a secure attachment of inner layer 22 to golf club iron 12. Magnets 28 may comprise any conventional magnetic materials such as alnico, ferrite, flexible rubber, and rare earth magnets including samarium, cobalt and/or neodymium. Inner layer 22 may include texturing or features 34, such as rubber or silicone dotting, to improve adhesion to golf club iron 12. Features 34 could be screen printed or adhered to inner layer 22, and can even be configured as a logo or trademark for manufacturer or sponsor identification purposes.

As seen in FIG. 2, the major surface of body 20 extends along a single plane and thus only covers the face of golf club iron 12, while leaving the rest of the club exposed. As a result, golf club face protector 10 does not cover any markings on golf club iron 12, nor will it form a pocket trapping moisture against golf club iron 12. As an alternative, body 20 could be formed from a unitary material having an inward face forming inner layer 22, and outward face forming outer layer 26 and a solid material therebetween in which magnets 28 are embedded and thereby forming intermediate layer 26 as an integrated whole. In addition, although not preferable from an aesthetic viewpoint, outer layer 26 could be omitted or only positioned in the location of magnets 28 to retain magnets 28 in place. Body 20 may be formed from fabrics or, alternatively, various polymers such as vinyl, or combinations thereof, with the primary requirement being flexibility to allow body 20 to reasonably conform to the shape of golf club iron 12.

Figure 3:
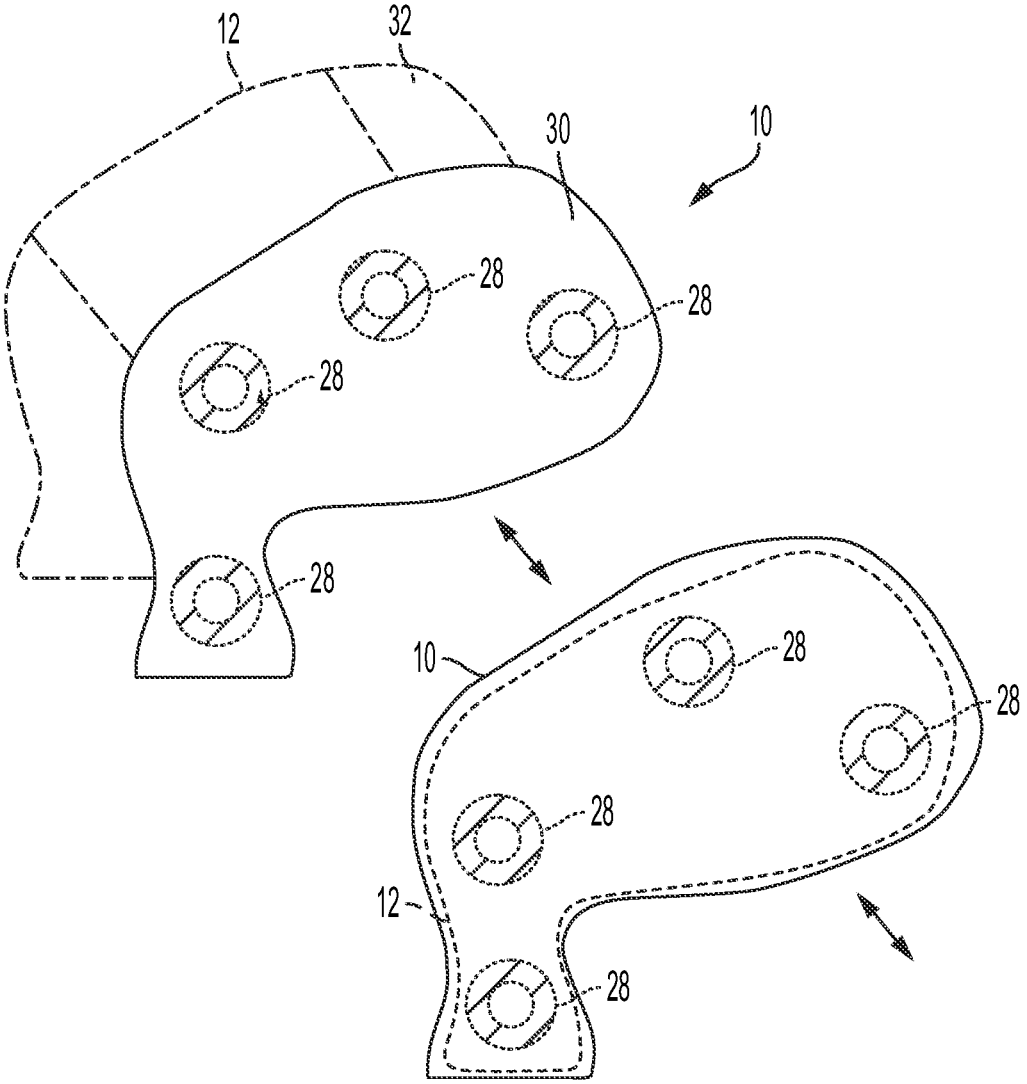
FIG. 3 is a front view of an exemplary approach for positioning a golf club face protector according to the present invention to the face of a golf club iron.

Referring to FIG. 3, the outer perimeter 30 of golf club face protector 10 generally corresponds to golf club iron 12 so that golf club face protector 10 can be positioned in covering relation to the front face 32 of golf club iron 12.

Figure 4:
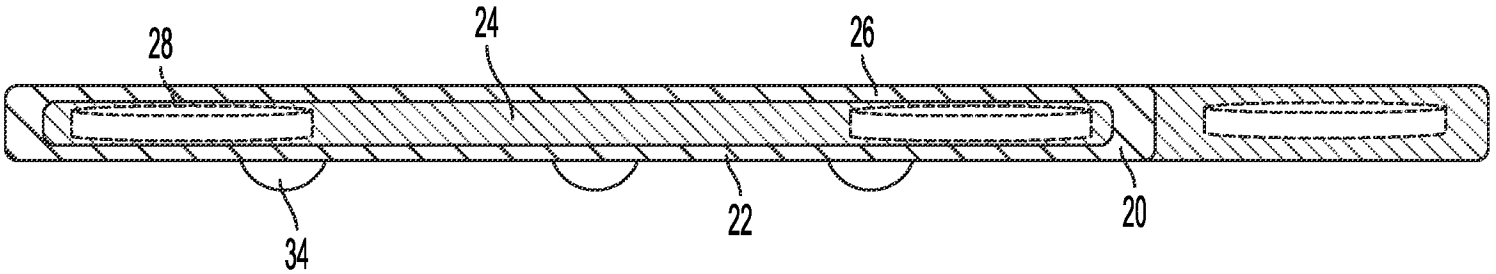
FIG. 4 is a cross-sectional view of a golf club face protector according to the present invention.

Referring to FIG. 4, magnets 28 are preferably support in intermediate layer 24 between inner layer 22 and outer layer 26. Inner layer 22 may be formed from a relatively soft material, such as felt, woven nylon, and the like. Intermediate layer 24 may be an empty chamber formed from inner layer 22 and outer layer 26, and may optionally filled with a suitable impact or shock absorbing/limiting material, such as foam, plastic, gel, rubber, fiber-filler, and the like. Outer layer 26 may be formed from the same materials as inner layer 22. Magnets 28 may comprise magnets of any available magnetic material and will be adhered to an intermediate material using readily acceptable binding methods such as gluing, stitching, wedging etc. Body 20 may be formed by fusing intermediate layer 24, inner layer 22, and outer layer 26 together using standard fabric-binding techniques such as stitching, gluing, heat-treating, or any other suitable fabric-binding methods.

What is claimed is:

1. A golf club protector, comprising:

a body extending along a single plane and having an inner layer providing a surface to be positioned against the face of a golf club, an outer layer, and an intermediate layer positioned between the inner layer and the outer layer, wherein the intermediate layer is formed by a shock absorbing foam and a series of magnets embedded in the shock absorbing foam and the inner layer and the outer layer are formed from a different material than the shock absorbing foam of the intermediate layer;

a series of resilient features dotting the surface of the inner layer and extending therefrom to promote adhesion to the face of the golf club; and wherein an outer perimeter of the body corresponds to a face of a golf club iron so that the body can cover the face of the golf club iron with the series of resilient dots of the inner layer in contact with the face of the golf club.

2. The golf club protector of claim 1, wherein the inner layer is formed from a flexible material.

3. The golf club protector of claim 2, wherein the outer layer is formed from a flexible material.

* * * * *